US006111483A

United States Patent [19]

Haapakoski

[11] Patent Number: 6,111,483

[45] Date of Patent: Aug. 29, 2000

[54] FILTER, METHOD OF MANUFACTURING SAME, AND COMPONENT OF A FILTER SHELL CONSTRUCTION

[75] Inventor: Ari Haapakoski, Paavola, Finland

[73] Assignee: ADC Solitra Oy, Oulu, Finland

[21] Appl. No.: 09/243,290

[22] Filed: Feb. 2, 1999

[30] Foreign Application Priority Data

Feb. 4, 1998 [FI] Finland ..... 980257

[51] Int. Cl.[7] ..... H01P 1/20; H01P 7/00

[52] U.S. Cl. ..... 333/202; 333/207; 333/219

[58] Field of Search ..... 333/202, 203, 333/206, 207, 219, 230, 235

[56] References Cited

U.S. PATENT DOCUMENTS

| | | | |
|---|---|---|---|
| 4,278,957 | 7/1981 | Starai | 333/202 |
| 4,706,051 | 11/1987 | Dieleman | 333/212 |
| 5,157,363 | 10/1992 | Puurunen et al. | 333/202 |
| 5,329,687 | 7/1994 | Scott | 29/527.2 |
| 5,491,604 | 2/1996 | Nguyen et al. | 333/219 |
| 5,850,169 | 12/1998 | Hietala | 333/235 |
| 5,990,763 | 11/1999 | Sipila | 333/202 |

FOREIGN PATENT DOCUMENTS 0599536 6/1994 European Pat. Off. .

*Primary Examiner*—Robert Pascal
*Assistant Examiner*—Patricia T. Nguyen
*Attorney, Agent, or Firm*—Ladas & Parry

[57] ABSTRACT

The invention relates to a filter, a method of manufacturing a filter and a component of a filter shell construction. The filter involved is particularly a multi-circuit filter comprising a plurality of resonance circuits and a conductive shell construction (21) comprising a wall construction (22, 22*a*, 22*b*) having walls, and a first and second end which close the shell construction providing the shell construction with a section construction defined by the wall construction and the ends, the section construction comprising one or more sections. The filter also comprises resonance circuit resonators in the section construction of the shell construction (2) in one or more sections (11 to 14) thereof. The filter further comprises coupling adjusting elements for adjusting the couplings between the different resonance circuits of the filter. In accordance with the invention, the resonators, at least in the areas on the side of the end, and the coupling adjusting elements are constructions provided at the end from the material of the end by impact extrusion.

39 Claims, 6 Drawing Sheets

FILTER, METHOD OF MANUFACTURING SAME, AND COMPONENT OF A FILTER SHELL CONSTRUCTION

FIELD OF THE INVENTION

The invention relates to a filter, particularly a multi-circuit filter comprising a plurality of resonance circuits and a conductive shell construction comprising a wall construction having walls, and a first and second end which close the shell construction providing the shell construction with a section construction defined by the wall construction and the ends, the section construction comprising one or more sections, the filter further comprising resonance circuit resonators in the section construction of the shell construction in one or more sections thereof, the filter further comprising coupling adjusting elements for adjusting the couplings between the different resonance circuits of the filter.

The invention also relates to a filter, particularly a multi-circuit filter comprising a plurality of resonance circuits and a conductive shell construction comprising a wall construction having walls, and a first and second end which close the shell construction providing the shell construction with a section construction defined by the wall construction and the ends, the section construction comprising one or more sections, the filter further comprising resonance circuit resonators in the section construction of the shell construction in one or more sections thereof, the filter further comprising coupling adjusting elements for adjusting the couplings between the different resonance circuits of the filter and/or frequency tuning elements for tuning the frequencies of the resonance circuits.

The invention further relates to a method of manufacturing a filter, particularly a multi-circuit filter, comprising manufacturing a shell construction having a wall construction, a first and second end and a section construction having at least one section, and a plurality of resonance circuit resonators in the section construction of the shell construction, providing the filter with coupling adjusting elements for adjusting the couplings between the resonance circuits, and providing the filter with frequency tuning elements for tuning the frequencies of the resonance circuits.

The invention also relates to a component of a filter shell construction, particularly an end of a shell construction.

BACKGROUND OF THE INVENTION

Radio frequency filters are employed to implement high-frequency circuits in e.g. base stations of mobile telephone networks. Filters may be used e.g. as interface circuits and filtering circuits in amplifiers of transmitters or receivers in base stations.

Resonator filters comprising a shell construction, or body, are of several types, e.g. coaxial resonator filters. In coaxial resonator filters, the shell construction envelops a conductor which is positioned in a section of the shell construction, i.e. a resonator cavity, and which is called a resonator or resonator rod. High-frequency filters, particularly more complex filters, are provided with a multi-section shell construction and what is known as a subdivision, or zoning. In this case, the resonator filter has a multi-section, or multicavity, shell construction, in other words, it comprises a plurality of resonator cavities, or sections in the shell construction, each of which constitutes a separate resonance circuit with the corresponding resonator, making the filter thus multi-circuit.

Coupling adjusting elements for adjusting the strength of the coupling between resonance circuits are used in filters in the area between the lower ends, or the inductive ends of the resonators. A coupling adjusting element is of a conductive material, and helps the resonators "see" each other more strongly, even though the coupling element does not even connect the resonators, since coupling takes place inductively via a magnetic field and since the position of the conductive coupling element in the area between the resonators shortens the length of the area between the resonators, i.e. the area which is free from conductive material.

Filters also employ frequency tuning elements.

The operating frequency, or resonance frequency, of a resonance circuit composed of a resonator and a section is tuned in order to make the resonance circuit operate in the desired manner, whereby a resonance circuit alone or, in practice, an integral unit composed of a plurality of resonance circuits, will implement a desired frequency response, which for example in the case of a bandpass filter is the passband, the signals inside of which the filter lets through.

It is known that the resonance frequency of a resonance circuit of a filter is tuned by changing the distance between the free end of the resonator and the grounded shell by means of a frequency tuning element, a shortened distance making the capacitance between the free end of the resonator and he shell increase and the resonance frequency decrease, whereas a longer distance makes the capacitance decrease and the resonance frequency increase.

Some known resonator filters are so manufactured that the shell construction and the resonators are manufactured from separate parts, whereby the resonators are e.g. soldered onto the bottom or cover of the shell construction, i.e. either end of the shell construction. Such a construction increases the probability of harmful intermodulation, and is slow to manufacture. Solutions are also known in which material is milled from a sufficiently large metal block, the remaining part of the block constituting the shell construction and resonator rods of the filter. Such a solution consumes much raw material and requires time-consuming manufacturing steps.

U.S. Pat. No. 4,706,051 discloses a solution according to which halves of a waveguide shell construction are manufactured by forging into a die, a slug of material is hit by a punch such that the material is displaced in the closed space between the die and the punch. This publication does not disclose any solution for manufacturing resonators. The solution has drawbacks, since it involves the manufacture of complementary halves of a shell, and since the slug material displaced as a result of punching to form a half of the shell construction does not flow freely, the closed die restricting the flow of the material.

U.S. Pat. No. 5,329,687 discloses a solution according to which both a shell construction and a resonator are molded or extruded from plastic as an integral unit to be coated with metal. However, the thermal conductivity of such a construction is not good. In addition, U.S. Pat. No. 4,278,957 discloses a solution according to which resonators are cast in the shell construction. The construction of the latter publication is manufactured by die casting, which requires a multi-element die arrangement which must open in at least three directions. On account of the material residues left in the joints of the die, a resonator made by die casting will not be entirely circular, which impairs the electrical properties of the resonator.

A construction made from thin sheet by punching or machining is known, in which the shell, the resonator and an adjusting projection for adjusting the inter-resonator coupling, are all an integral unit, i.e. made from the same thin sheet as one piece, which is bent into the shape of a shell. The problem is that the free ends of the wall portions to be bent have to be soldered in order to prevent leakage points. Since a thin sheet is involved, said technique does not necessarily provide such material strengths for the shell and the resonator which are required by some applications consuming power and requiring a strong wall construction and resonator.

Known coupling adjusting elements for adjusting the strength of the coupling between resonance circuits are whiskers, threads or other projections soldered or otherwise fastened to the resonator or the shell construction in the area between the resonators.

Known resonance circuit frequency tuning elements are tuning bolts placed in the end of the shell construction, such as the cover, or elsewhere in the shell construction. It is common to said tuning elements that they are separate parts with respect to the resonators and the shell construction and have to be fastened separately to the resonator or the filter, which increases the number of components and slows down and complicates the manufacture.

BRIEF DESCRIPTION OF THE INVENTION

It is an object of the present invention to provide a new type of filter avoiding the problems associated with known solutions.

This object is achieved with the filter of the invention, which is characterized by the resonators, at least in the areas on the side of the end, and the coupling adjusting elements being constructions provided at the end from the material of the end by impact extrusion.

This object is achieved with the filter of the invention, which is characterized by the resonators, at least in their area on the side of the end, being constructions provided at the end by impact extrusion from the material of the end.

The method of manufacturing a filter according to the invention is characterized by the resonators being impact extruded, or cold extruded, from the material of the end onto the end of the shell construction.

The component of a filter shell construction, in turn, is characterized by the end of the shell construction, either alone, or with a wall construction of the shell construction, being a solid integral unit comprising two or more of the following groups as constructions impact extruded from the material of the end: impact extruded resonators, impact extruded coupling adjusting elements, impact extruded frequency tuning elements.

The solution of the invention provides a plurality of advantages. The method of the invention solves, or eliminates, the joining problem between the lower end of the resonators and the end of the shell. The invention does not require a solder or any other joining method between the lower end of the resonator and the shell construction. The method of the invention reduces the number of separate components in the products, and the intermodulation problems with the product are clearly less serious than in products assembled from separate parts. The solution of the invention saves raw material as compared with the milling method. The solution of the invention also improves the quality factor of the filter, as no joint is needed between the lower end of the resonator and the bottom of the shell construction. The new solution reduces the weight of the filter and the number of manufacturing steps. The invention provides better thermal conductivity as compared with known solutions extruded from plastic and coated with a conductive material, such as metal. In the solution of the invention, the shell construction and the resonators can be produced by a single motion, and the die has to open in only one direction. The solution of the invention allows the cross-sections of the resonators to be made completely circular. The preferred embodiments and other more detailed embodiments of the invention emphasize the advantages of the invention. Furthermore, the invention allows the tuning and adjusting elements, such as the elements for adjusting the strength of the coupling between the resonance circuits and the elements for tuning the resonance frequencies of the resonance circuits, to belong to the same integral unit with the resonators, further reducing the number of separate components. The construction of the invention integrates the resonators as part of the end piece of the shell, and, if desired, said tuning and adjusting elements can be impact extruded as part of the end piece of the shell in the same way as the resonators, whereby the extent of integration still increases.

BRIEF DESCRIPTION OF THE DRAWINGS

In the following the invention will be described in greater detail in association with preferred embodiments with reference to the attached drawings, in which.

DETAILED DESCRIPTION OF THE INVENTION

Figure 1:
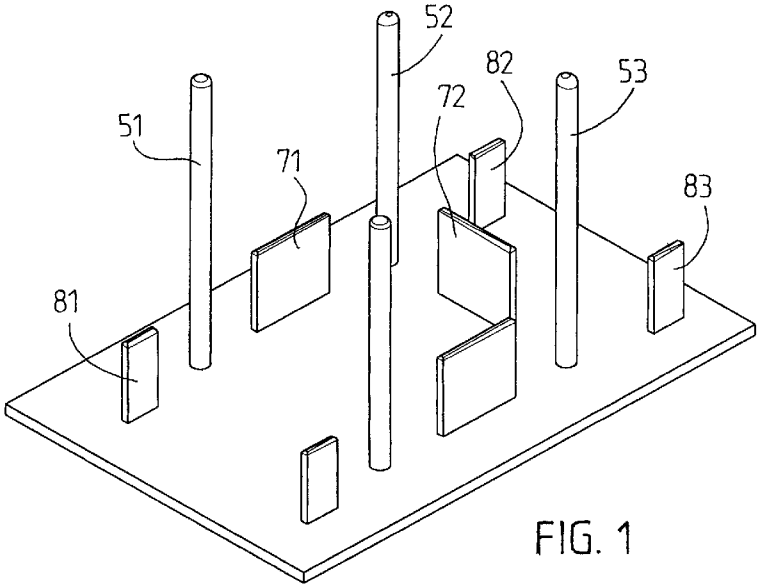
FIG. 1 is an oblique top view of the end, i.e. end piece, of the shell construction of a four-circuit filter and of resonators, coupling adjusting elements and frequency tuning elements impact extruded thereto before the resonators have been bent and the tuning and adjusting elements provided with openings or otherwise processed.

Referring to FIGS. 1 to 9, the invention most preferably relates to a radio frequency filter 1, e.g. a bandpass filter. Said filter 1 is multi-circuit, i.e. a filter 1 comprising a plurality of resonance circuits 11 to 14 and a conductive shell construction 21 comprising a wall construction 22 having walls 22*a*, 22*b* and a first end 31 and a second end 32. The ends 31, 32 of the shell construction close the shell construction 21 providing the shell construction 21 with a section construction defined by the wall construction 22 and the ends, the section construction comprising one or more sections 41 to 44, in this example 4 sections. The wall construction comprises outer walls 22*a* and inner partition walls 22*b*. The partition walls 22*b* separate the sections 41 to 44 from each other.

The filter 1 further comprises resonance circuit 11 to 14 resonators 51 to 54, which are in one or more sections 41 to 44 of the section construction of the shell construction. The filter 1 also comprises coupling adjusting elements 71 to 73 for adjusting the couplings between the different resonance circuits 11 to 14 of the filter, i.e. for adjusting the strength of the coupling of a signal from one resonator to another.

Figure 4:
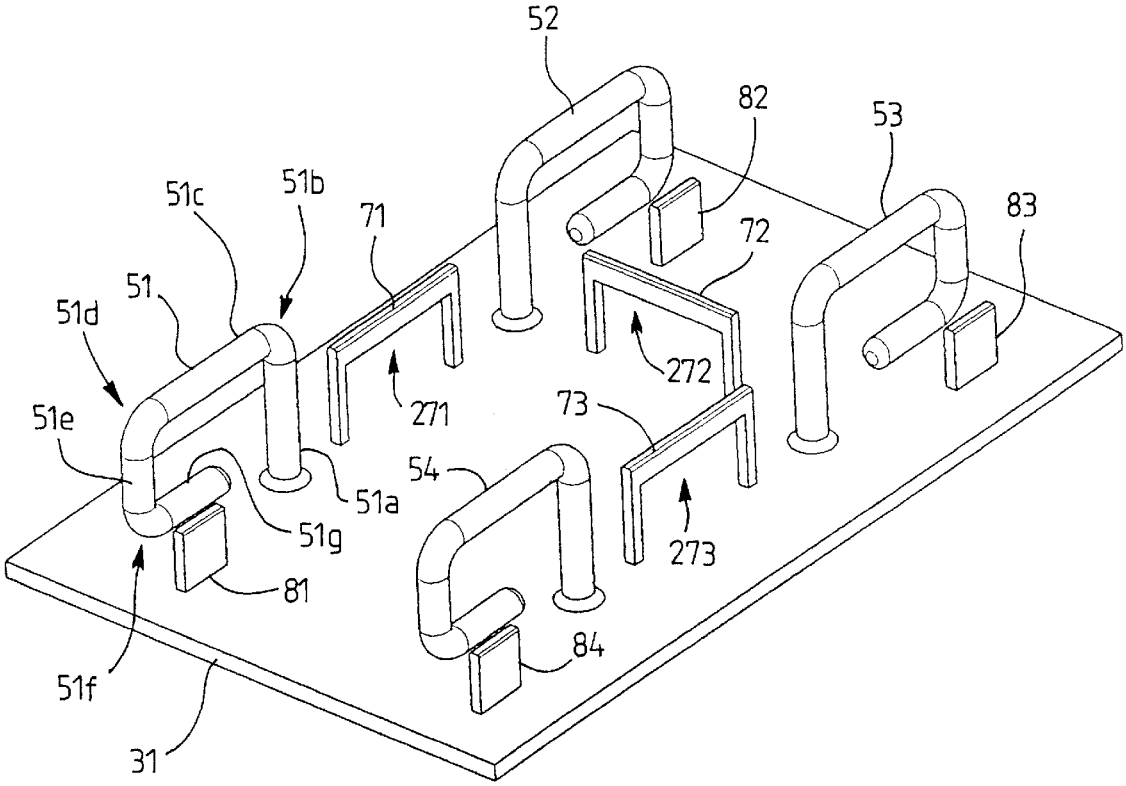
FIG. 4 shows the construction of FIG. 1 after the resonators have been bent and the tuning and adjusting elements provided with openings or otherwise processed.
Figure 6:
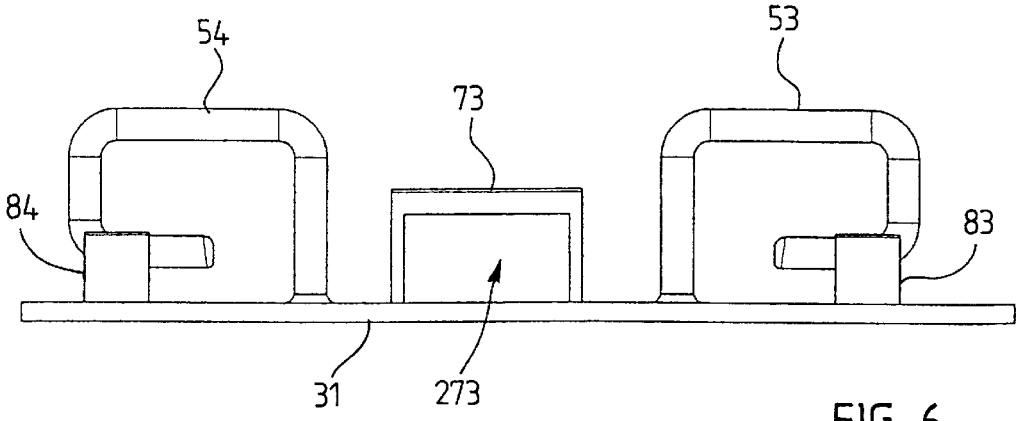
FIG. 6 is a side view of FIG. 4.
Figure 5:
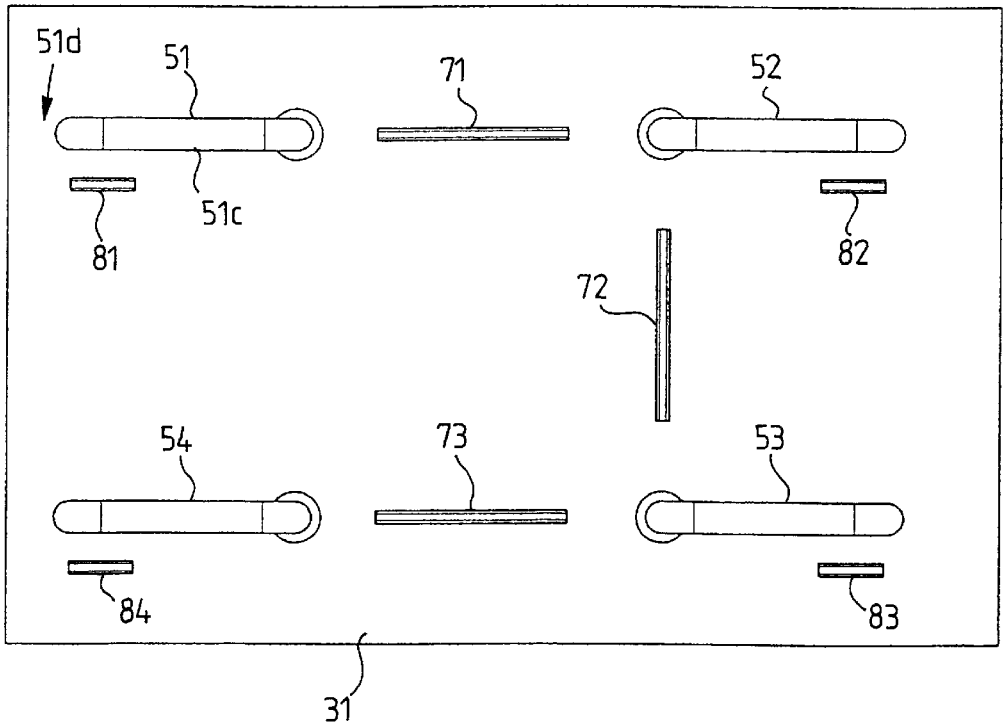
FIG. 5 is a top view of FIG. 4.

FIGS. 4 to 6 shows that the shell construction of the filter, or the wall construction of the shell construction, most preferably the partition walls 22*b*, comprise coupling openings 71 to 73, via which a signal is able to be coupled from the resonator of a resonance circuit to the resonator of another resonance circuit. The coupling adjusting elements are most preferably by the coupling openings 61 to 63, most preferably extending from one section to another.

Accordingly, four resonance circuits have four resonators, and most preferably a corresponding number of sections 41 to 44, i.e. four sections. However, the number of separate sections can be less than the number of resonators 51 to 54 if the partition walls 22*b* are low, or if the partition walls are provided with so large coupling openings 61 to 63 that the partition wall remains very small.

In the filter of the invention, the resonators 51 to 54, at least in their areas on the side of the end 31, i.e. the resonator root area, or base area, and the coupling adjusting elements are constructions provided at the end by impact extrusion from the material of the end. Impact extrusion naturally takes place before the shell 21 is assembled, i.e. the extrusion is carried out in a piece used as the billet of the end 31.

The filter most preferably also comprises frequency tuning elements 81 to 84 (181 to 182 in FIGS. 10 to 11) for tuning the frequency of the resonance circuits. Each resonance circuit 11 to 14 has a dedicated frequency tuning element 81 to 84. In a preferred embodiment of the invention, the frequency tuning elements 81 to 84 are also provided at the end 31, as in FIGS. 1 to 9, or at the end 32, as in FIGS. 10 to 11, in which reference numbers 181 and 182 denote the frequency tuning elements. In other words, the frequency tuning elements also are constructions impact extruded from the material of the end 31 or 32 and provided at the end 31 of the shell construction, as in FIGS. 1 to 9, or at the end 32, as in FIGS. 10 to 11.

The couplings are adjusted by the coupling adjusting elements 71 to 73 and the frequency tuned by the frequency tuning elements 81 to 84 when the filter is being tuned at the factory. In other words, in a way it is a question of a setting procedure instead of continuous tuning. The settings/tunings remain as final set values/tuning values controlling the operation of the filter when the filter leaves the factory to its place of use, such as a cellular radio network or other telecommunication system.

In a preferred embodiment, the end 31 of the shell construction, to which the extrusions are made, can be a different piece with respect to the wall construction 22 of the shell construction, as in FIGS. 1 to 9, 11. In this preferred embodiment in FIGS. 1 to 9, 11, the end 31, from whose material the resonators 51 to 54 have been impact extruded onto the end 31, is such an end 31 which is a separate piece with respect to the wall construction 22 of the shell construction 21, but is, however, in contact with the wall construction 22 in order to close the section construction of the shell construction on that side of the wall construction 22, to which the end 31 of the shell construction 21 is placed. In FIGS. 1 to 9 and 11, the second end, i.e. the upper end 32, may also be a piece separate from the wall construction, whereby the end 32 is a separate cover, or it, or the end 32, can be of the same piece as the wall construction 22, as FIGS. 1 to 9, 11 actually show.

Figure 9:
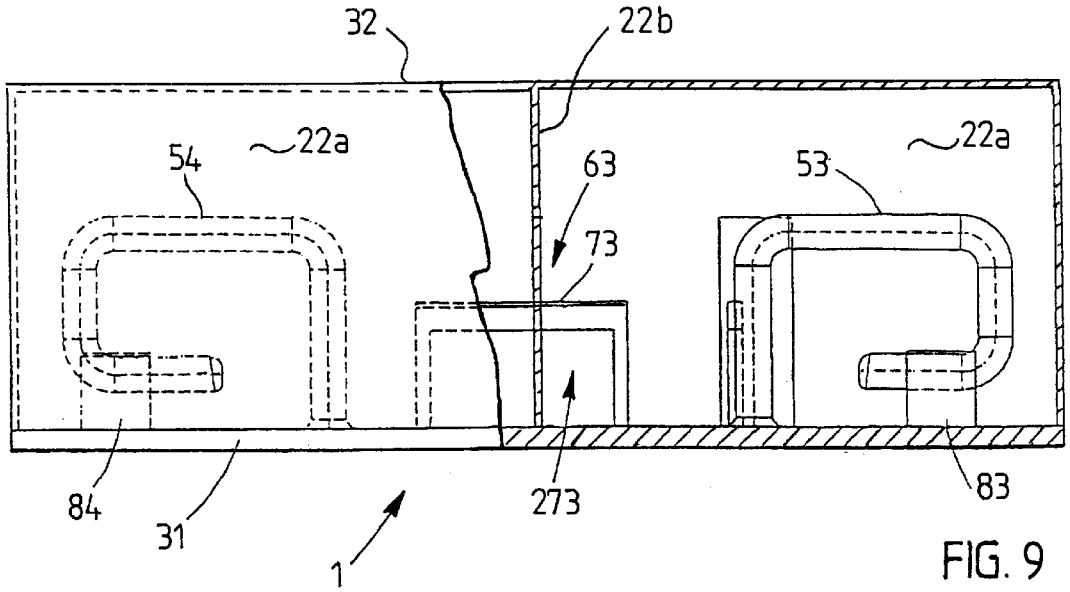
FIG. 9 shows the construction of FIG. 6 including the other parts of the shell construction.
Figure 10:
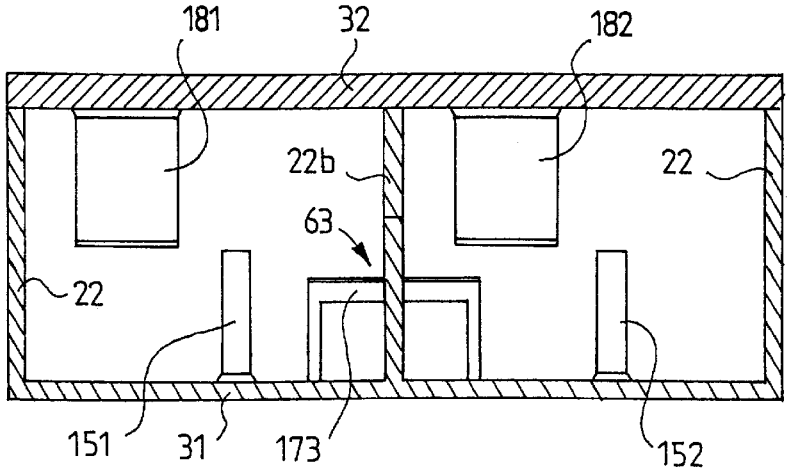
FIG. 10 shows an embodiment with the wall construction of the shell construction also extruded from the material of the end.

FIG. 10, in turn, shows an embodiment with the wall construction 22 of the shell construction 21 also extruded from the material of the end. In the preferred embodiment shown in FIG. 10, the end 31, from whose material the resonators, denoted by reference numerals 151, 152, are impact extruded onto the end 31, is such an end from whose material the wall construction 22 of the shell construction 21, and its side walls 22*a* and partition walls 22*b*, are also impact extruded. In this case the second end 32 is such an end which is a separate piece with respect to the wall construction 22 of the shell construction 21, being, however, in contact with the wall construction in order to also close the section construction of the shell construction from that side of the wall construction on which the second end 32 of the shell construction is placed. In FIG. 10, the second end 32 is a separate cover, to which the frequency tuning elements 181, 182 have been extruded. As regards FIGS. 10 to 11 in particular, but also FIGS. 3, 6 and 9, it should be noted that naturally they, too, have a corresponding number of resonators as in the other figures, but because of the direction in which the figure is presented, the two other resonators remain hidden behind the two visible resonators. In the side views of FIGS. 3, 6, 9 and 10 to 11, some coupling adjusting elements and some frequency tuning elements are hidden, too.

Figure 11:
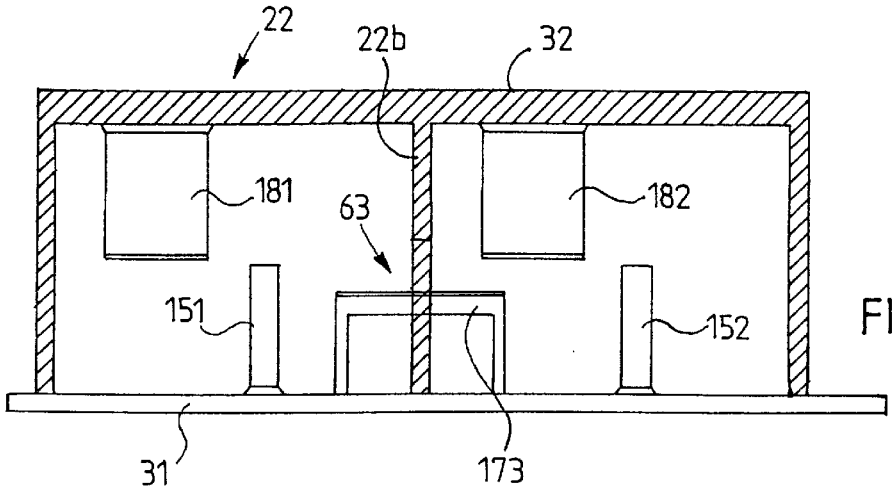
FIG. 11 shows an embodiment with the frequency tuning elements at a different end than the resonators and coupling adjusting elements, FIG. 12 schematically shows a tool arrangement for impact extruding the end of a shell construction.

As to extrusion of the resonators 51 to 54, it was stated above that at least the areas of the resonators on the side of the end 31 are extruded from the end 31. In order for the impact extrusion of the resonators 51 to 54, or 151 to 152, to fully contribute to reducing the number of parts, in a preferred embodiment the filter is such that along substantially their entire lengths the resonators 51 to 54 in FIGS. 1 to 9 and the resonators 151, 152 in FIGS. 10 to 11 are constructions impact extruded onto the end of the shell construction from the material of the end, as is shown in the figures.

In a preferred embodiment according to FIGS. 1 to 11, the coupling adjusting elements 71 to 73 and the resonators 51 to 54, and 151 to 152, respectively, are constructions impact extruded from the material of the end 31 and provided at the same end 31 of the shell construction 21. This is an advantageous embodiment because the coupling is adjusted from the inductive end of the resonator, i.e. from the side of the root, or base, of the resonator, whereby in this embodiment the coupling adjusting elements 71 to 73 are extruded into the right place, which simplifies the construction.

Alternatively, the coupling adjusting elements are constructions impact extruded from the material of another end onto said other end of the shell construction with respect to the end comprising the resonator. This construction could be achieved if in FIGS. 10 to 11 the coupling adjusting means 73 were extruded onto the cover, i.e. the end 32, and if the coupling adjusting means 73 extended sufficiently low in the area between the resonators, and if the partition wall 22 were very narrow (not shown). However, this embodiment is not as advantageous as the one described above.

Referring to FIGS. 1 to 9, in a preferred embodiment the frequency tuning elements 81 to 83 and the resonators are constructions impact extruded onto the same end of the shell construction from the material of the end. This increases the integration degree and further simplifies manufacture.

Alternatively, as shown in FIGS. 10 to 11, the frequency tuning elements 181 to 182 are constructions impact extruded from the material of a different end 32 onto said different end 32 of the shell construction 21 with respect to the end 31 comprising the resonators 151, 152. This is an advantageous embodiment, particularly if a more common straight resonator is used, or generally a resonator whose capacitive end is on the side of a different end 32 than the end 31 from which the resonator, or, more exactly, its inductive end, starts.

Quite often in practical applications, in a preferred embodiment of the invention, the wall construction of the shell construction 21 of the filter comprises several sections 41 to 44, separated by the partition walls 22*b* of the wall construction of the shell construction, the sections 41 to 44 being in the area between the ends 31, 32 of the shell construction, the wall construction 22 defining the height of the section. In this case each resonance circuit 11 to 14 comprises, in addition to its resonator 51 to 54, a dedicated section 41 to 44. In practical applications the end 31, which is provided with the constructions impact extruded from the material of the end, is at a substantially right angle transversely with respect to the walls comprised by the wall construction. The second end 32 is similarly arranged. In this case the side view of the sections is also regular, i.e. rectangular.

In a preferred embodiment of the invention, shown in FIGS. 1 to 9 and 11, the end 31 of the shell construction is a planar piece, from which project constructions impact extruded onto it, that is, the resonators 51 to 54 and 151, 152, and/or coupling adjusting elements 71 to 73 and/or frequency tuning elements. Consequently, the wall construction 22 of the shell construction 21 is of a separate piece with respect to the ends 31, 32. As regards the end 31, such a construction is simpler to manufacture, an additional advantage being that when the ends 31, 32 are pieces separate from the wall construction 21, the same end pieces can be used with wall constructions of different heights.

In the invention, the end of the shell construction is of a metal material, and consequently, the resonators 51 to 54 and coupling adjusting elements 71 to 73 and/or frequency tuning elements 81 to 83, impact extruded onto the end 31 from the material of the end, are also of the same metal material. The embodiment simplifies and integrates the invention and improves the electrical properties.

Figure 2:
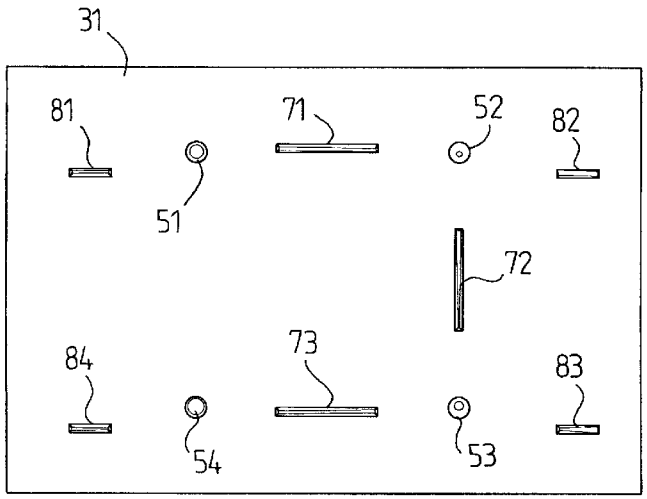
FIG. 2 is a top view of FIG. 1.
Figure 3:
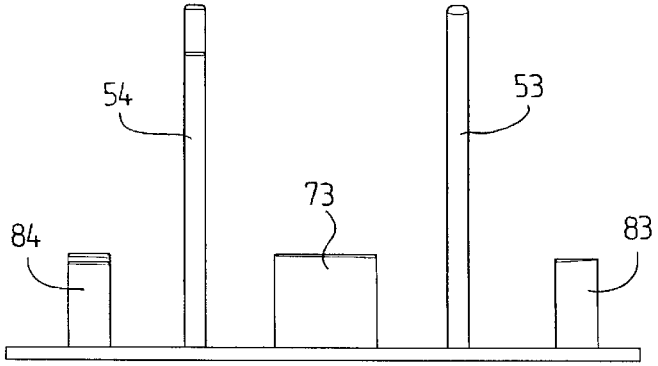
FIG. 3 is a side view of FIG. 1.

Let us next study the difference between FIGS. 4 to 6 and FIGS. 1 to 3. FIGS. 1 to 3 show the situation after extrusion before the further measures to be taken after the extrusion. In a preferred embodiment of the invention, after impact extrusion, the resonator is a bent hook-like resonator, which has been bent back towards the end 31 onto which it has been impact extruded from the material of said end 31. In this case the natural location of the coupling adjusting elements 71 to 73 is at the same end 31. A hook-like resonator allows a sufficiently long electric length to be achieved with a shorter physical length. More exactly, the resonators 51 to 54 are such that in a preferred embodiment of the invention, an impact extruded and bent resonator, e.g. 51, comprises an initial part 51*a* projecting from the end of the shell construction, then a first turning point 51*b*, where the resonator 51 turns substantially transversely with respect to the initial part 51*a*, then a first intermediate part 51*c*, which is substantially transverse with respect to the initial part 51*a*, then a second turning point 51*d*, where the resonator 51 turns back towards the end, after the second turning point a second intermediate part 51*e*, which is directed back towards the end, and next a third turning point 51*f*, where the resonator 51 again turns transversely with respect to the initial part 51*a*, now towards the initial part, and next, i.e. preferably last, an extension part 51*g*, which is arranged transversely towards the initial part 51*a*. Such a construction allows frequency to be tuned between the free, i.e. capacitive end, i.e. extension part 51*g*, of the resonator and the end 31 of the shell, whereby the frequency tuning element can be impact extruded onto the end 31, i.e. the same end as the resonators 51 and 54 and the coupling adjusting elements 71 to 73.

A further comparison between FIGS. 4 to 6 (and 7 to 9) and FIGS. 1 to 3 shows that as regards the coupling adjusting elements between the resonance circuits 11 to 14, in a preferred embodiment of the invention the coupling adjusting element impact extruded onto the end 31 comprises an opening 273 provided in the impact extruded coupling element, e.g. the adjusting element 73, the adjusting element 73 provided with the opening thus being loop-shaped comprising an initial point at the end of the shell construction and a finishing point at the end of the shell construction. The coupling adjusting element forming a loop provides a sufficiently clear effect on the coupling between the resonance circuits, e.g. 11 and 12, i.e. between the resonators 51 and 52. In a preferred embodiment of the invention the coupling adjusting elements 71 to 73 are disposed on a line between the resonators, whereby the effect is at its clearest. All coupling adjusting elements 71 to 73 are provided with openings.

Figure 7:
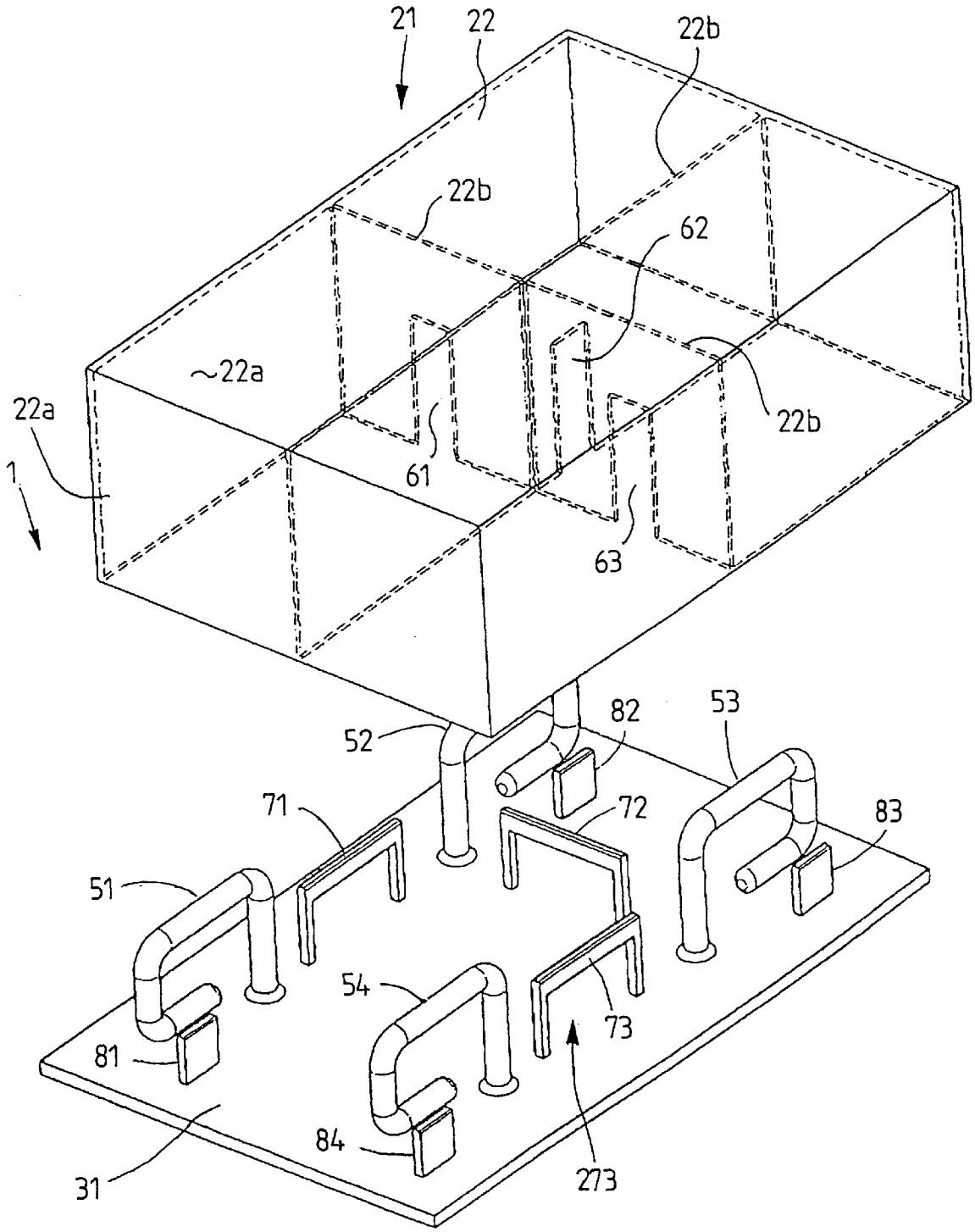
FIG. 7 shows the construction of FIG. 4 including the other parts of the shell construction.
Figure 8:
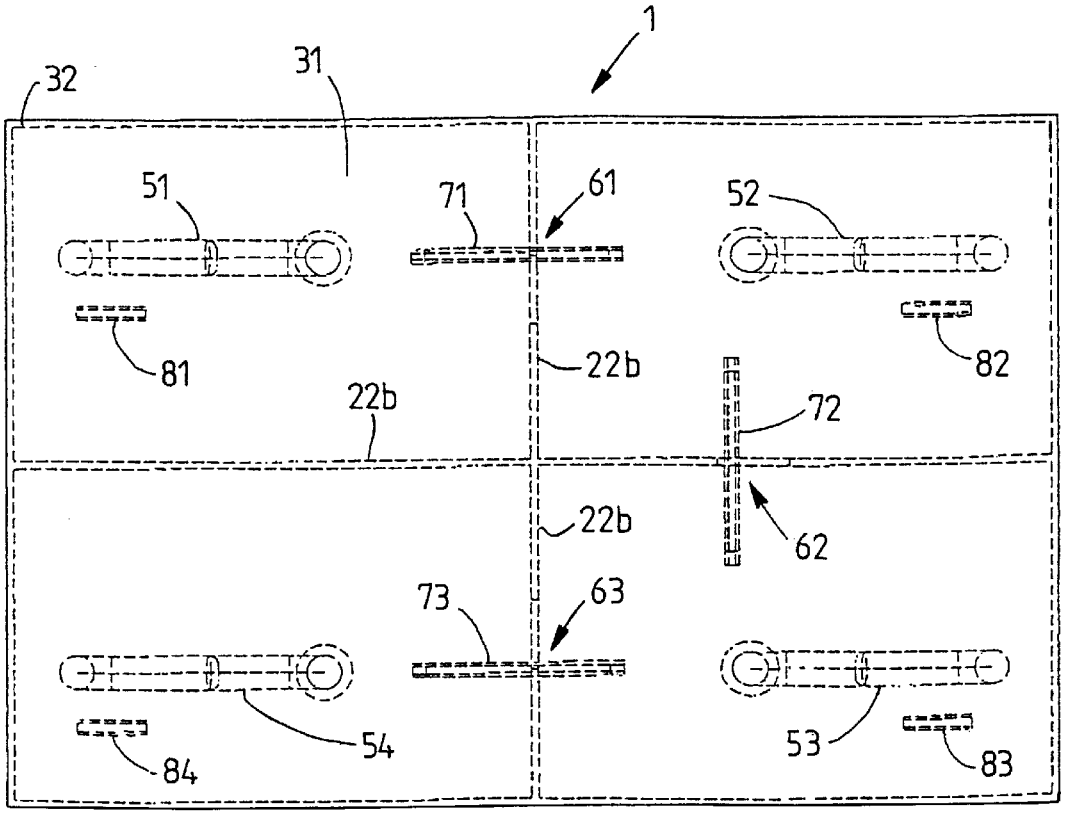
FIG. 8 shows the construction of FIG. 5 including the other parts of the shell construction.

A study of the structure of a finished fully encased filter in FIGS. 7 to 9 reveals a difference as compared with FIGS. 4 to 6 in that the coupling adjusting elements 71 to 73 and the frequency tuning elements 81 to 83 are subjected to procedures for setting the strengths between the couplings between the resonance circuits as desired and setting the resonance frequency of each resonance circuit. The procedures the adjusting and tuning elements 71 to 73 and 81 to 83 are subjected to may be e.g. bending, grinding or other machining, by which the position of an adjusting or tuning element is slightly changed, resulting in the desired result as far as the frequency band of the filter is concerned.

FIGS. 1 to 9 shows that the end 31 comprising the impact extruded resonators 51 to 54 and the coupling adjusting elements 71 to 73 and/or the frequency tuning elements 81 to 83 is either the cover or the bottom of the shell construction, depending on the definition. In FIG. 10, the upper end, which could be called e.g. the cover, is provided with extruded frequency tuning elements 181 to 182, and the lower end, which could be called e.g. the bottom, is provided with extruded resonators 151, 152 and coupling adjusting elements, such as 73, and further the wall construction 22, 22*a*, 22*b* of the shell construction.

In a preferred embodiment, extrusion produces an extremely advantageous construction, in which the resonators 51 to 54 and the coupling adjusting elements 71 to 73 and/or the frequency tuning elements 81 to 83 are the same integral unit extruded from the same slug, or billet, used to produce the end 31 of the shell construction 21.

In addition to the entire filter, the invention may be studied as a part of the shell construction of a filter, particularly as an end of a shell construction. In this case the end 31 of the shell construction is either separate, as in FIGS. 1 to 9 and 11, or, integrated into a solid integral unit with the wall construction 22 of the shell structure 21, as in FIG. 10, comprises as a construction impact extruded from the material of the end 31, two or more of the following groups: impact extruded resonators 51 to 54, impact extruded coupling adjusting elements, impact extruded frequency tuning elements. Said at least two groups can be at different ends 31, 32, but are preferably at the same end, i.e. the end 31 in accordance with FIGS. 1 to 9. In FIGS. 1 to 9, for example, the same end comprises as many as three groups, i.e. resonators, coupling adjusting elements and frequency tuning elements. Similarly, in FIG. 10, the same end 31 comprises as many as three groups, i.e. resonators 151, 152, coupling adjusting elements, such as 173, and the wall construction 22, 22*a*, 22*b* of the shell construction. FIG. 11 shows two groups at each end, i.e. resonators 151, 152 and coupling adjusting elements, such as 173, at the end 31 and frequency tuning elements 181, 182 and the wall construction of the shell construction at the second end 32.

A version having all four groups at the same end is also feasible, and this would mean that in FIG. 10 the frequency tuning elements at the end 32 would be extruded onto the end 31 from the material of the end 31.

Referring to the above, particularly to FIG. 10, it may be stated that in a preferred embodiment of the invention, a part of the shell construction, particularly the end 31 of the shell construction, is such that the end of the shell construction further comprises the walls 22*a*, 22*b* of the wall construction 22 of the shell construction 21 as a construction impact extruded from the material of the end.

The invention may also be considered as a method of manufacturing a filter. A method of manufacturing a multi-circuit filter, in particular, is involved, comprising manufacturing a shell construction 21 comprising a wall construction 22, 22*a*, 22*b*, a first end 31 and a second end 32 and a section construction comprising at least one section, and resonators 51 to 54 of a plurality of resonance circuits 11 to 14 in the section construction of the shell construction 21. The filter is further provided with coupling adjusting elements 71 to 73 for adjusting the couplings between the resonance circuits 11 to 14. The filter is also provided with frequency tuning elements 81 to 83 for tuning the frequencies of the resonance circuits.

It is essential to the above method that the resonators 51 to 54 are impact extruded, or cold extruded, onto the end of the shell construction from the material of the end.

As has been stated above about the filter with reference to FIGS. 1 to 9 and 11, in a preferred embodiment of the method, the resonators 51 to 54 are impact extruded onto such an end 31 of the shell construction 21 that is a separate piece with regard to the wall construction of the shell construction, but is joined together with the wall construction 22, 22*a*, 22*b* after the impact extrusion in order to close the section construction of the shell construction from said side of the wall construction on which the end of the shell construction is positioned. This ensures that the end 31 comprising the extruded constructions and the wall construction remain separate pieces, which is advantageous in some applications.

As has been stated above about the filter with reference to FIG. 10, in a second preferred embodiment of the method, the resonators are impact extruded onto such an end 31 of the shell construction from which the wall construction 22, 22*a*, 22*b* is also impact extruded, further increasing the extrusion integration.

To allow wide extrusion integration, in addition to the resonators 51 to 54, the coupling adjusting elements 71 to 73 of the resonance circuits are also impact extruded onto the end of the shell construction from the material of the end of the shell construction, either to the same end 31 as the resonators or to the second end, i.e. the end 32, even though impact extrusion onto the same end is to be preferred. In a preferred embodiment the method is such that the frequency tuning elements are impact extruded onto the end of the shell construction from the material of the end of the shell construction, either onto the same end 31 as the resonators, as in FIGS. 1 to 9 or onto the second end 32, as in FIGS. 10 to 11.

Referring to FIGS. 1 to 9, in a preferred embodiment of the invention, the resonators, the coupling adjusting elements and the frequency tuning elements are impact extruded onto the same end. This version is particularly suitable for hook-like resonators shown in FIGS. 1 to 9.

The resonators and frequency tuning elements in FIGS. 10 to 11 are extruded onto the same end 31, and the frequency tuning elements 181, 182 are extruded onto the second end 32.

As was stated regarding the filter, in a preferred embodiment of the method, the resonators impact extruded onto the end 31 are bent 51 to 54 after the impact extrusion, or impact molding, or cold extrusion, such that the resonators projecting from the end 31 are bent back towards the end 31. This allows the combination of an efficient extrusion technique producing an integrated construction and the bending producing physically short resonators.

As regards the method of manufacturing the coupling adjusting elements, in a preferred embodiment the method is such that the coupling adjusting elements 71 to 73 impact extruded onto the end 31 are provided with openings, e.g. by machining, boring or otherwise. In the preferred embodiment the coupling adjusting elements are provided with openings to form loops.

In the method, the end 31 and/or end 32 being extruded are of a metal material, and impact extrusion is carried out by extruding the metal block used for producing the end 31 and 32. The material is preferably aluminium or copper.

Figure 12:
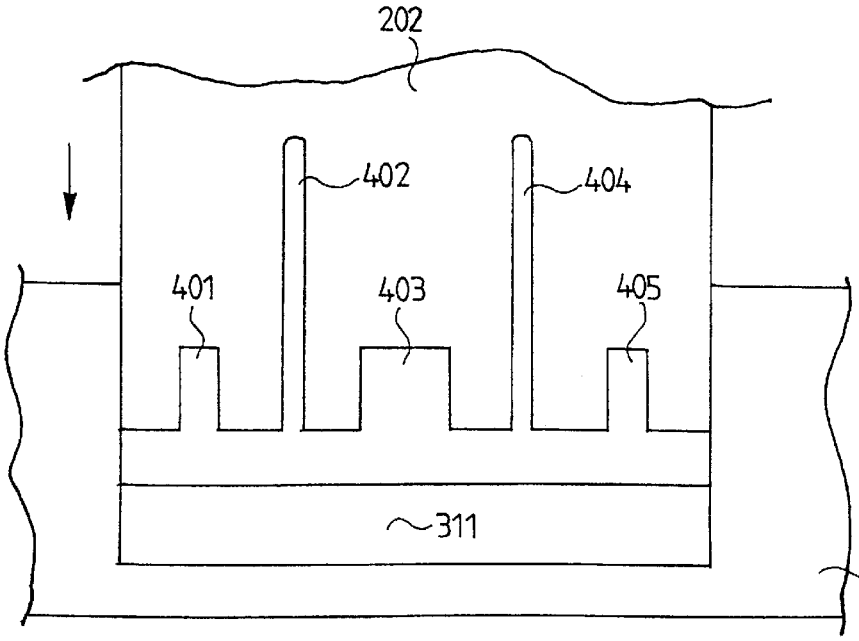

Reference is finally made to FIG. 12, which schematically shows a tool arrangement 200 for impact extrusion of the end of the shell construction. In FIG. 12 the tool arrangement comprises a die underlayer 201 and an extrusion impact tool 202. In a preferred embodiment of the invention the method is consequently such that the resonators 51 to 54, and the coupling adjusting elements 71 to 73 and/or the frequency tuning elements 81 to 84 and/or the wall construction 22, 22*a*, 22*b* are extruded by the same tool arrangement 200, 202. Most preferably the resonators 51 to 54 and the coupling adjusting elements and/or the frequency tuning elements and/or the wall construction are extruded in the same manufacturing step by the same impact movement, making the method fast and effective.

Referring to FIG. 12, in a preferred embodiment the extrusion is carried out by subjecting a slug 311, i.e. a billet 311, of the end 31, preferably of a metal material and disposed on the underlayer and employed for producing the end, to intense compression, whereby the material of the slug 311 is forced by the extrusion to spaces 401 to 405 in the tool arrangement, the spaces defining the extrusion space for the resonators and the coupling elements and/or the frequency tuning elements and/or the wall construction. FIG. 12 shows an impact tool and die for producing the resonators, the coupling adjusting elements and the frequency tuning elements to the end 31 by extruding the billet 311 of the end.

During extrusion, the end 31, i.e. the billet 311, naturally becomes thinner since other constructions are extracted from its material. Should the wall construction also be extracted from the billet of the end 31, then a suitable initial thickness of the billet is e.g. 15 mm, the thickness of a completed end being decreased to about 3 mm.

If the wall construction 22 is not extruded from the billet 311 of the end 31, then the change compared with the completed end is not that significant.

The applicant has found the suitable thickness for a shell construction to be between 0.5 and 2 mm. Similarly, a suitable thickness, or diameter, of a resonator is between 3 and 6 mm, a suitable thickness for the adjusting and tuning elements being between 0.5 and 2 mm. This way the constructions can be easily extruded, but can also be easily bent and machined.

The slug, or billet 311, is most preferably of a metal material, whereby the resonators and other extruded constructions are of metal. In this case the resonators and other extruded constructions do not have to be subjected to further processing by any thick coatings. To increase the electric conductivity of the basic metal, a coating may, however, be applied.

A filter should preferably comprise at least 3 to 4 resonance circuits for the filter to operate well.

As regards the coupling elements 71 to 73 and the coupling openings 61 to 63, it is still pointed out that in multi-circuit resonator filters the resonance circuits are adapted by what is known as coupling to each other such that the resonator filter provides the desired frequency response in the frequency range. By coupling the resonance circuits, each resonance circuit is coupled to the next resonance circuit in the coupling scheme of the filter.

Even though the invention has been described above with reference to the example according to the attached drawings, it is to be understood that the invention is not limited thereto, but can be modified in a variety of ways within the inventive idea disclosed in the attached claims.

What is claimed is:

1. A filter, particularly a multi-circuit filter comprising a plurality of resonance circuits and a conductive shell construction comprising a wall construction having walls, and a first and second end which close the shell construction providing the shell construction with a section construction defined by the wall construction and the ends, the section construction comprising one or more sections, the filter further comprising resonance circuit resonators in the section construction of the shell construction in one or more sections thereof, the filter further comprising coupling adjusting elements for adjusting the couplings between the different resonance circuits of the filter, wherein the resonators, at least in the areas on the side of the end, and the coupling adjusting elements are constructions provided at the end from the material of the end by impact extrusion.

2. A filter, particularly a multi-circuit filter comprising a plurality of resonance circuits and a conductive shell construction comprising a wall construction having walls, and a first and second end which close the shell construction providing the shell construction with a section construction defined by the wall construction and the ends, the section construction comprising one or more sections, the filter further comprising resonance circuit resonators in the section construction of the shell construction in one or more sections thereof, the filter further comprising coupling adjusting elements for adjusting the couplings between the different resonance circuits of the filter and/or frequency tuning elements for tuning the frequencies of the resonance circuits, wherein the resonators, at least in their area on the side of the end, are constructions provided at the end by impact extrusion from the material of the end.

3. A filter as claimed in claim 1, wherein the end, from whose material the resonators have been impact extruded onto the end, is such an end which is a separate piece with respect to the wall construction of the shell construction, but which is, however, in contact with the wall construction in order to close the section construction of the shell construction on that side of the wall construction, to which the end of the shell construction is placed.

4. A filter as claimed in claim 1, wherein the end, from whose material the resonators have been impact extruded, is such an end from which also the wall construction of the shell construction is impact extruded, and by the second end being such an end which is a separate piece with respect to the wall construction of the shell construction, being, however, in contact with the wall construction in order to also close the section construction of the shell construction from that side of the wall construction on which the second end of the shell construction is placed.

5. A filter as claimed in claim 1, wherein the resonators are, along substantially their entire lengths, constructions impact extruded onto the end of the shell construction from the material of the end.

6. A filter as claimed in claim 1, wherein, for tuning the resonance frequencies of the resonance circuits of the filter, the filter further comprises frequency tuning elements for the resonance circuits, and that the frequency tuning elements are also constructions impact extruded onto the end of the shell construction from the material of the end.

7. A filter as claimed in claim 2, wherein the coupling adjusting elements are constructions impact extruded onto the end of the shell construction from the material of the end.

8. A filter as claimed in claim 2, wherein the frequency tuning elements are also constructions impact extruded onto the end from the material of the end.

9. A filter as claimed in claim 1, wherein the coupling adjusting elements are constructions impact extruded onto the same end of the shell construction as the resonators from the material of the end.

10. A filter as claimed in claim 1, wherein the coupling adjusting elements are constructions impact extruded from the material of a different end to said different end of the shell construction with regard to the end comprising the resonators.

11. A filter as claimed in claim 2, wherein the frequency tuning elements are constructions impact extruded onto the same end of the shell construction as the resonators from the material of the end.

12. A filter as claimed in claim 2, wherein the frequency tuning elements are constructions impact extruded from the material of a different end to said different end of the shell construction with regard to the end comprising the resonators.

13. A filter as claimed in claim 1, wherein, in the section construction, the shell construction of the filter comprises several sections separated by the wall construction of the shell construction from each other, and that the sections are in the area between the ends of the shell constructions, and that a resonance circuit comprises a section in addition to its resonator.

14. A filter as claimed in claim 1, wherein the end, which is provided with the constructions impact extruded from the material of the end, is at a substantially right angle transversely with respect to the walls comprised by the wall construction.

15. A filter as claimed in claim 1, wherein the end of the shell construction is a planar piece, from which the constructions impact extruded onto it project.

16. A filter as claimed in claim 1, wherein the coupling adjusting element impact extruded onto the end comprises an opening provided in the impact extruded coupling adjusting element, the coupling adjusting element provided with the opening thus being loop-shaped comprising an initial point at the end of the shell construction and a finishing point at the end of the shell construction.

17. A filter as claimed in claim 1, wherein the end of the shell construction is of a metal material, and consequently, the resonators and coupling adjusting elements and/or frequency tuning elements, impact extruded onto the end from the material of the end, are also of the same metal material.

18. A filter as claimed in claim 1, wherein the impact extruded resonators and coupling adjusting elements and/or the frequency tuning elements are either the cover or the bottom of the shell construction.

19. A filter as claimed in claim 1, wherein the resonators and coupling adjusting elements and/or the frequency tuning elements are the same integral unit extruded from the same slug.

20. A filter as claimed in claim 1, wherein the coupling adjusting elements are disposed on a line between the resonators.

21. A filter as claimed in claim 1, wherein the resonator is a bent hook-like resonator, which after impact extrusion has been bent back towards the end onto which it has been impact extruded from the material of the end.

22. A filter as claimed in claim 21, wherein the impact extruded and bent resonator comprises an initial part projecting from the end of the shell construction, a first turning point, where the resonator turns substantially transversely with respect to the initial part, a first intermediate part, which is substantially transverse with respect to the initial part, a second turning point, where the resonator turns back towards the end, a second intermediate part, which is directed back towards the end, a third turning point, where the resonator again turns transversely with respect to the initial part, now towards the initial part, and an extension part, which is arranged transversely towards the initial part.

23. A method of manufacturing a filter, particularly a multi-circuit filter, comprising manufacturing a shell construction having a wall construction, a first and second end and a shell construction comprising a section construction having at least one section, and a plurality of resonance circuit resonators in the section construction of the shell construction, providing the filter with coupling adjusting elements for adjusting the couplings between the resonance circuits, and providing the filter with frequency tuning elements for tuning the frequencies of the resonance circuits, wherein the resonators are impact extruded, or cold extruded, from the material of the end onto the end of the shell construction.

24. A method as claimed in claim 23, wherein the resonators are impact extruded onto such an end of the shell construction which is a separate piece with respect to the wall construction of the shell construction, but which is, however, in contact with the wall construction in order to close the section construction of the shell construction on that side of the wall construction, to which the end of the shell construction is placed.

25. A method as claimed in claim 23, wherein the resonators are impact extruded onto such an end of the shell construction, from which the wall construction of the shell construction is also impact extruded.

26. A method as claimed in claim 23, wherein, in addition to the resonators, the coupling adjusting elements of the resonance circuits are also impact extruded onto the end of the shell construction from the material of the end of the shell construction, either onto the same end as the resonators or onto the second end.

27. A method as claimed in claim 23, wherein the frequency tuning elements are also impact extruded onto the end of the shell construction from the material of the end of the shell construction, either onto the same end as the resonators or onto the second end.

28. A method as claimed in claim 26, wherein both the resonators, coupling adjusting elements and the frequency tuning elements are impact extruded onto the same end.

29. A method as claimed in claim 26, wherein the resonators and coupling adjusting elements are impact extruded onto the same end and the frequency tuning elements being impact extruded onto the second end.

30. A method as claimed in claim 23, wherein the resonators impact extruded onto the end are bent after impact extrusion in such a manner that the resonator projecting from the end is bent back towards the end.

31. A method as claimed in claim 24, wherein the coupling adjusting elements impact extruded onto the end are provided with openings.

32. A method as claimed in claim 32, wherein the coupling adjusting elements are provided with openings into the shape of a loop.

33. A method as claimed in claim 23, wherein the end is of a metal material and that impact extrusion is carried out by extruding a metal block used to provide said end.

34. A method as claimed in claim 23, wherein manufacturing a multi-circuit high-frequency filter comprises a plurality of sections and a plurality of resonators.

35. A method as claimed in claim 23, wherein the resonators and coupling adjusting elements and/or frequency tuning elements are extruded in the same manufacturing step by the same impact movement.

36. A method as claimed in claim 23, wherein the resonators and coupling adjusting elements and/or frequency tuning elements are extruded by the same tool arrangement.

37. A method as claimed in claim 23, wherein the extrusion is carried out by subjecting a slug, preferably of a metal material and disposed on an underlayer and employed for producing the end, to intense compression, whereby by the material of the slug is forced by the extrusion to spaces in a tool arrangement, the spaces defining the extrusion space for the resonators and the coupling elements and/or the frequency tuning elements and/or the wall construction.

38. A component of a filter shell construction, particularly an end of a shell construction, wherein the end of the shell construction, either alone, or with a wall construction of the shell construction, is a solid integral unit comprising two or more of the following groups as constructions impact extruded from the material of the end: impact extruded resonators, impact extruded coupling adjusting elements, impact extruded frequency tuning elements.

39. A component of a filter shell construction, particularly an end of a shell construction, wherein the end of the shell construction further comprises the walls of the wall construction of the shell construction as a construction impact extruded from the material of the end.

* * * * *